US011891197B2

(12) United States Patent
Colombo et al.

(10) Patent No.: US 11,891,197 B2
(45) Date of Patent: Feb. 6, 2024

(54) APPARATUS FOR WRAPPING A FILM AROUND AN OBJECT AND RELATED METHOD

(71) Applicant: ATLANTA STRETCH S.P.A., Poggia Torriana (IT)

(72) Inventors: Luca Colombo, Cesenatico (IT); Gianluca Paci, Verucchio (IT)

(73) Assignee: Atlanta Stretch S.P.A., Poggia Torriana (IT)

( * ) Notice: Subject to any disclaimer, the term of this patent is extended or adjusted under 35 U.S.C. 154(b) by 0 days.

(21) Appl. No.: 17/709,366

(22) Filed: Mar. 30, 2022

(65) Prior Publication Data

US 2022/0315257 A1 Oct. 6, 2022

(51) Int. Cl.
*B65B 41/16* (2006.01)
*B65B 11/02* (2006.01)

(52) U.S. Cl.
CPC ..... *B65B 11/025* (2013.01); *B65B 41/16* (2013.01)

(58) Field of Classification Search
USPC ..... 53/461
See application file for complete search history.

(56) References Cited

U.S. PATENT DOCUMENTS

2002/0179769 A1* 12/2002 Dreckmann ..... B65H 18/16 242/542.3
2007/0157557 A1* 7/2007 Lancaster ..... B65B 11/045 53/399

* cited by examiner

*Primary Examiner* — Chinyere J Rushing-Tucker
(74) *Attorney, Agent, or Firm* — Woodard. Emhardt, Henry, Reeves & Wagner, LLP

(57) ABSTRACT

The present invention refers to an apparatus and a method for wrapping a film around an object. The apparatus includes a device capable of being electrostatically charged and capable of transmitting the electrostatic charge to the portion of film that comes out of the carriage. In this way, the fixing of the leading end flap of the film around the object to be wrapped is thus facilitated. In fact, the leading end flap of the film, as soon as it is dispensed, remains stretched out of the carriage and, as soon as it meets the object to be wrapped, it immediately fastens to it due to the attraction force. The rotation is then activated to wrap the film around the object. The apparatus is simple to make, cheap, and highly efficient.

10 Claims, 8 Drawing Sheets

APPARATUS FOR WRAPPING A FILM AROUND AN OBJECT AND RELATED METHOD

FIELD OF THE INVENTION

The present invention relates to an apparatus and a method for wrapping a film around an object. In particular, the present invention relates to such an apparatus (and relative method using this apparatus) provided with an electrostatically charged bar capable of transmitting this charge to the portion of film as soon as it comes out of a reel-holder carriage to facilitate the automatic fixing of the film around an object to be wrapped by this film.

STATE OF THE ART

Various known in the art devices are used to apply a film to an object to be protected with such a film, such as wrapping machines, taping machines, and the like.

Typically, wrapping machines can be classified as manual, semi-automatic and automatic machines.

Manual wrapping machines are those where practically no type of mechanical automation is required to support the actions performed by an operator.

Semi-automatic wrapping apparatus, particularly suitable for low production, is an apparatus wherein the operator intervention is required at each packaging cycle to bring the object to be wrapped A or apparatus B in the wrapping position (see FIG. 1*a*, and FIG. 1*b*, respectively), hook the film to the object to be wrapped A, start the winding, cut the film at the end of the cycle and take the object to be wrapped A or move the apparatus B to a new position. With reference to FIG. 1*b* and in particular to the movable elements of apparatus B rotating around the stationary object, there are no automatic coupling systems; it is always the operator who fixes the film to the object to be wrapped before starting the wrapping cycle. FIG. 1*c* shows another known in the art semi-automatic wrapping apparatus wherein the film rotates around the object to be wrapped fixed to the ground by means of a rotating arm 18.

Automatic wrapping apparatus (for high productions) are apparatus integrated in packaging lines where all the operations are automated, that is: handling of the object to be wrapped, film hooking to the object to be wrapped at the beginning of the cycle, object wrapping in the desired mode, film cutting at the end of the cycle. The operator must only carry out the functions of checking and replenishing consumables.

There are also hybrid devices that are halfway between the two described above types of apparatus wherein, starting from semi-automatic apparatus, to speed up the cycle and reduce human intervention, only some operations are automated with the addition of devices such as automatic cutting or automatic cutting and hooking, indicated with 16 and 17 in FIG. 2.

For example, with reference to FIG. 2 and in particular to fixed station apparatus, known in the art automatic and semi-automatic apparatus for wrapping objects with stretch film are shown. They are typically composed of a reel-holder carriage 1 which houses the film 6; a vertical column 2 along which the reel-holder carriage 1 moves from the bottom up and vice versa; a base 3 which causes the object to be wrapped 4 to rotate on itself, resting on a pallet 15. When the film 6 is attached to the object 4 or to a system 5 which holds it integral with it, the rotation of the object 4 to be wrapped causes the leading end flap 9 of the film 6 to be tensioned between the object to be wrapped 4 and the reel-holder carriage 1. The tension of the leading end flap 9 of the film 6 activates the reel-holder carriage 1 which then dispenses the film 6. Due to the rotation and to the vertical movement of the reel-holder carriage 1 along the column 2, the object to be wrapped 4 is wound in a spiral.

In the apparatus where the automatic hooking of the film 6 is provided (FIG. 2), at the start of the cycle, the latter is hooked to a system 5. At start-up, the film 6 is essentially tensioned by the rotation movement and consequently extracted from the carriage 1; for this reason, the system 5 which holds the film 6 must guarantee a sufficient seal to keep it under tension. Once the reels of the extensible film 6 have overlapped around the object to be wrapped 4, the system 5 releases the film 6, and then resumes it at the end of the cycle for the next wrapping; it must therefore be governed in the various winding stages.

The addition of these components clearly entails the addition of costs and complications.

The Chinese patent application published with n. CN 108 016 672 A describes an equipment for packaging an object using a film. The apparatus described therein is able to eliminate the charges that may eventually form on the film due to the contact between a drive roller and the film when the film is unwound from the film-holder carriage during the object packaging process. In fact, thanks to the presence of a brush that contacts the film, any annoying electrostatic charges possibly present on the film are attracted by the brush and then discharged from the film. Therefore, any charges present in excess onto the film, after it has exited the film-holder carriage, pass from the film to the brush, thus making the film charge neutral. There is no reference to how to fix the leading end portion of the film to the object to be wrapped.

U.S. Pat. No. 5,564,258 discloses another system for packaging an object by means of a film. At the end of the packaging process, the tail end portion of the film is allowed to adhere to a retaining element and held therein in place by vacuum, or by means of a sticky surface, or by ionizing the air that passes through special openings. This retaining element is an element external to the structure that houses the film-holder carriage and is positioned at the object to be wrapped, where the tail end portion of the film is found at the end of the wrapping process.

In the Chinese patent application published with No. CN 110 451 020, a load is wrapped by a stretch film. To keep the film taut as it exits the film-holder carriage, the upper and lower part of the film itself are subjected to an electrostatic charge; in this way, these upper and lower parts of the film are prevented from flexing and overlapping each other. The phenomenon of lamination is thus avoided. There is no reference to how to fix the leading end portion of the film to the object to be wrapped.

However, none of the prior art cited above documents deal with the technical problem of how to fix the leading end portion of the film to the object to be wrapped, so that no intervention by an operator is required.

Therefore, the Applicant has faced the technical problem of providing an apparatus to facilitate the fastening of a leading end film flap around an object as soon as this flap comes out of a film-holder carriage, to obtain a simple and economical system of film dispensing and its fixing around the object to be wrapped.

SUMMARY OF THE INVENTION

In a first aspect, the present invention refers to an apparatus for wrapping a film around an object.

The Applicant of the present application has in fact surprisingly found that the technical problem encountered above can be solved in an effective and reliable way by means of an apparatus for wrapping a film around an object, wherein said apparatus comprises a carriage adapted to house a reel of said film and provided with an opening to allow said film to come out of the carriage itself.

The apparatus further comprises a device placed at said opening of said carriage and adapted to be electrostatically charged and able to transmit said charge to the leading end portion of the film which comes out from said carriage to fix itself to the object to be wrapped.

In this way, the fixing of the leading end flap of the film around the object to be wrapped is thus facilitated.

In fact, thanks to the transfer of the electrostatic charge to the leading end flap of the film, this one, as soon as it meets the object to be wrapped, it is immediately fixed to it due to the attraction force.

Therefore, the film does not rest on the ground, thus avoiding leaving unsightly or annoying tails at the base of the object itself but remains adherent and taut on the object to be wrapped.

Consequently, once the film is fixed to the object, it is sufficient to start the wrapping around the object to be wrapped by dispensing the film from the carriage for the required quantity.

It is therefore an apparatus of simple construction, economic, and highly efficient, not requiring any manual intervention of an operator.

The apparatus of the present invention acts in the opposite way to the apparatus described in CN 108 016 672 A, where the charge present in excess onto the plastic film is passed to the brush, making null the charge of the film. Conversely, in the present invention, it is the film that is loaded with the electrostatic charge to facilitate the fixing of the leading end flap of the film around the object to be wrapped.

The term "apparatus" in the present description and in the attached claims means any machine used to apply a film to an object to be protected with such a film, such as winding machines, both with vertical axis and with horizontal axis, whether they are manual, semi-automatic or automatic; rotary arm machines, rotary table machines, rotary ring machines, shrink wrapping machines, semi-moving robots, taping machines, and the like.

According to a preferred embodiment, said device adapted to be electrostatically charged is placed along the path travelled by the film to come out of the carriage, substantially at said opening of the carriage.

In this way, the electrostatic charge is transmitted only to the portion of film exiting the carriage.

According to a preferred embodiment, said device is a bar adapted to be electrostatically charged. In particular, said device is an ionizing bar on which a series of emitting tips (electrodes) are fixed.

In this way, when the bar is powered, it emits positive ions which are transferred from the bar to the ground which acts as a negative. This allows the stretch film, during its path, to pass through this ion beam and become electrostatically charged.

The apparatus of the present invention further comprises a motorized roller adapted to facilitate said film the come out from the carriage.

In this way, the film exit from the carriage is automated.

According to a preferred embodiment, the apparatus of the present invention further comprises a fan capable of generating air blades designed to direct said film towards the object to be wrapped.

In this way, the air flow generated by the fan runs substantially parallel to the film itself exiting the carriage and conveys the electrostatically charged film towards the object to be wrapped.

According to a preferred embodiment, the apparatus of the present invention further comprises a movable body integral with said carriage able to rotate around said object to be wrapped.

In this way, the apparatus of the present invention is able to rotate around said object, consequently causing the film wrapping around the object itself.

According to a preferred embodiment, said movable body is provided with at least one wheel to facilitate its movement. In another alternative embodiment, said movable body is operated by means of an articulated rotating arm, integral with said carriage, which rotates around the object to be wrapped fixed to the ground.

According to a preferred embodiment, said apparatus is also provided with a vertical column along which said carriage is able to slide up and/or down.

In this way the vertical column acts as a vertical guide to the carriage.

In a second aspect the present invention relates to a method for wrapping a portion of film around an object.

The Applicant of the present application has in fact surprisingly found that the technical problem encountered above can be solved effectively and reliably by means of a method for wrapping a portion of a film around an object using an apparatus comprising: a) a carriage adapted to house a reel of said film, b) an opening adapted to allow said film to come out of the carriage, and c) a motorized roller adapted to facilitate said release of the film from the carriage through said opening; wherein said method comprises the steps of:

a) allowing the leading end flap of said film to come out from said carriage through said opening;
b) electrostatically charging said leading end flap of the film before or during its coming out from the carriage;
c) allowing said leading end flap of the electrostatically charged film to be fixed onto said object;
d) wrapping said leading end flap of said film around said object and thereafter also wrapping the remaining portion of the film on it as it comes out from said carriage.

In this way, thanks to the transfer of the electrostatic charge on the leading end flap of the film, this, once released from the carriage, is fixed to the object to be wrapped, automatically, without the need for any intervention by an operator. After that, the wrapping around the object to be wrapped starts by dispensing the film from the carriage for the required quantity.

Consequently, the film does not rest on the ground, thus avoiding leaving unsightly or annoying tails at the base of the object itself, but it remains adherent and taut on the object to be wrapped.

According to a preferred embodiment, said step a), wherein the leading end flap of the film comes out of the carriage through said opening, is facilitated by activating said motorized roller.

According to a preferred embodiment, said step b) is carried out firstly by step b1) wherein a device substantially arranged at said opening of the carriage is electrostatically charged, and subsequently by step b2) wherein said electrostatic charge is transferred from said device to said leading end flap of said film.

According to a preferred embodiment, said device is an ionizing bar able to be electrostatically charged in said phase b1). A series of emitting tips (electrodes) are fixed on said bar.

In this way, when the bar is powered, it emits positive ions which in said phase b2) are transferred from the bar towards ground which acts as a negative. This allows the stretch film, during its journey, to pass through this ion beam and become electrostatically charged.

According to a preferred embodiment, said leading end flap of the film released from said carriage is directed towards said object to be wrapped by means of air blades generated by a fan placed in correspondence with said opening of the carriage.

According to a preferred embodiment, the air flow generated by the fan is parallel to the film.

In this way, the air flow generated allows the leading end flap of the film to be conveyed directly towards the object to be wrapped.

According to a preferred embodiment, said leading end flap of the film coming out of said carriage is fixed to the object to be wrapped by bringing the object and the leading end flap of the film closer together.

In this way, the leading end flap of the film is fixed to the object to be wrapped due to the attraction force generated by the presence of the electrostatic charge.

According to a first preferred embodiment, said step d) of wrapping a portion of said film around said object takes place by rotating said object to be wrapped around itself in proximity to said apparatus. Preferably, in this first embodiment, the object to be wrapped with the film is positioned on a pallet which, in turn, is positioned on a rotating base; therefore, in this first embodiment, the object to be wrapped rotates on itself near the apparatus, which instead remains fixed.

According to a second alternative preferred embodiment, said step d) of wrapping a portion of said film around said object is carried out by means of a rotation of a movable body of said apparatus, integral with said carriage, around said object to be wrapped placed on the pallet, which remains fixed to the ground.

According to a preferred embodiment, once the first round of wrapping the film around the object has been completed, said method includes the further step e) of deactivating the transfer of the electrostatic charge towards the portion of film exiting the carriage.

In fact, once the fastening of the film around the object has been consolidated by completing the first turn, it is no longer necessary to supply the electrostatic charge to the new portion of film exiting the carriage.

According to a preferred embodiment, said wrapping of said film around said object to be wrapped ends when the object has been wrapped for a desired number of times, based on the shape and size of the object to be wrapped.

Further features and advantages of the present invention will be better highlighted by examining the following detailed description of preferred but not exclusive embodiments, illustrated only as an indication and not limitative with the support of the attached drawings.

DETAILED DESCRIPTION

The following detailed description refers to particular embodiments of the apparatus 10 of the present invention designed to wrap a film 6 around an object 4, without limiting its content.

Figure 1A:
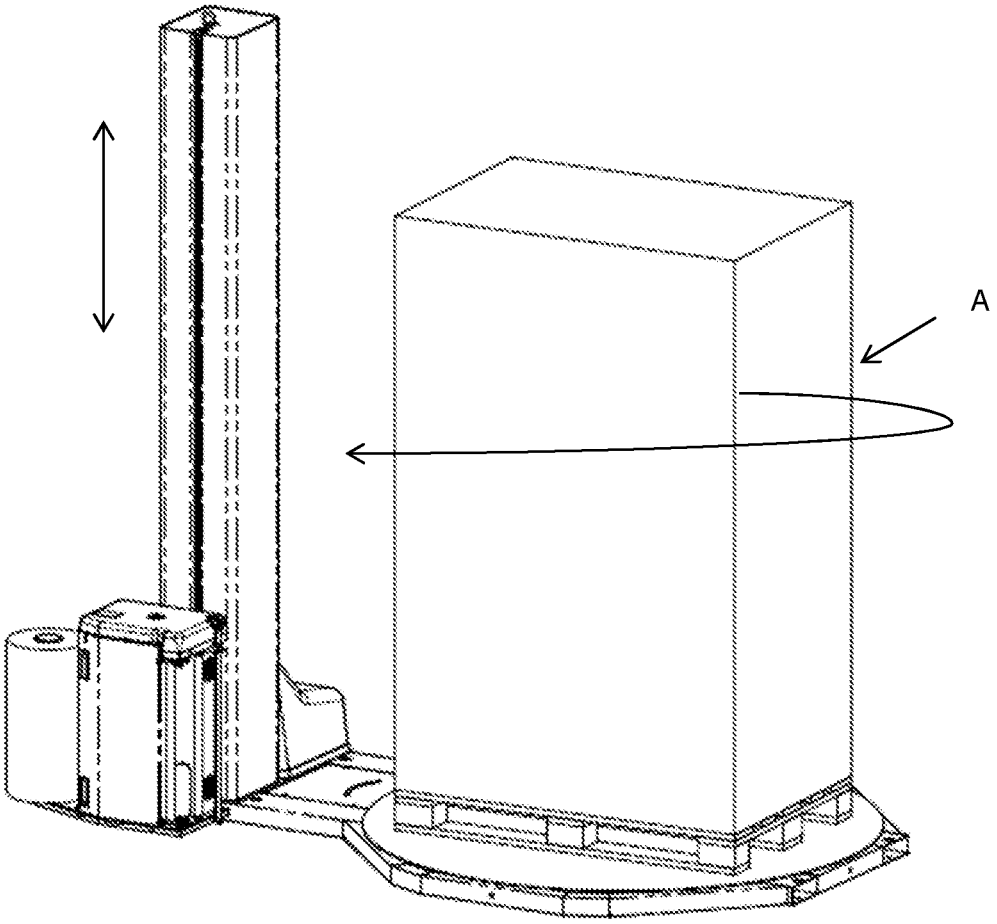
Figure 1a (Prior art)
FIG. 1*a* is an axonometric view of a known in the art semi-automatic apparatus to wrap a film around an object placed on a pallet, wherein the latter one rotates around the apparatus, which is instead fixed.
Figure 1B:
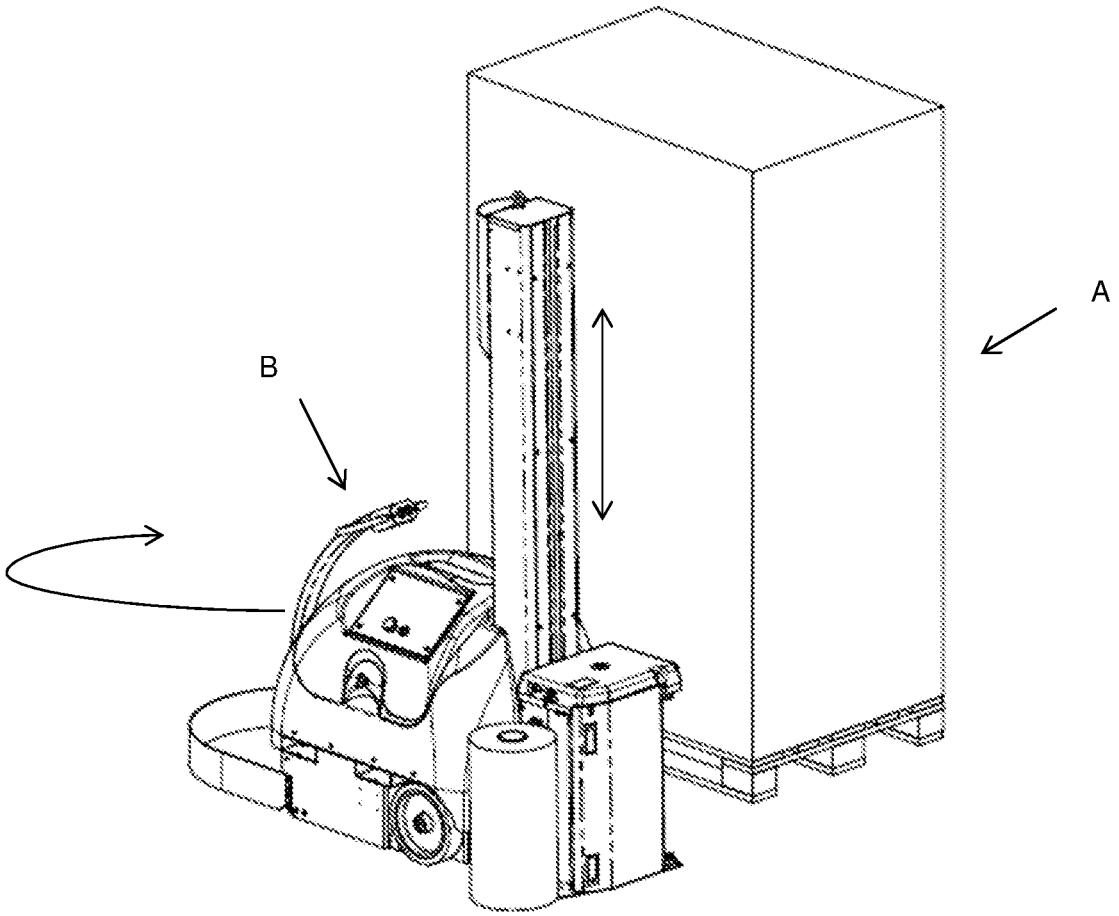
Figure 1b (Prior art)
FIG. 1*b* is an axonometric view of a known in the art semi-automatic apparatus for wrapping a film around an object placed on a pallet, wherein the apparatus rotates around the object to be wrapped with the film, which instead it is fixed.
Figure 1C:
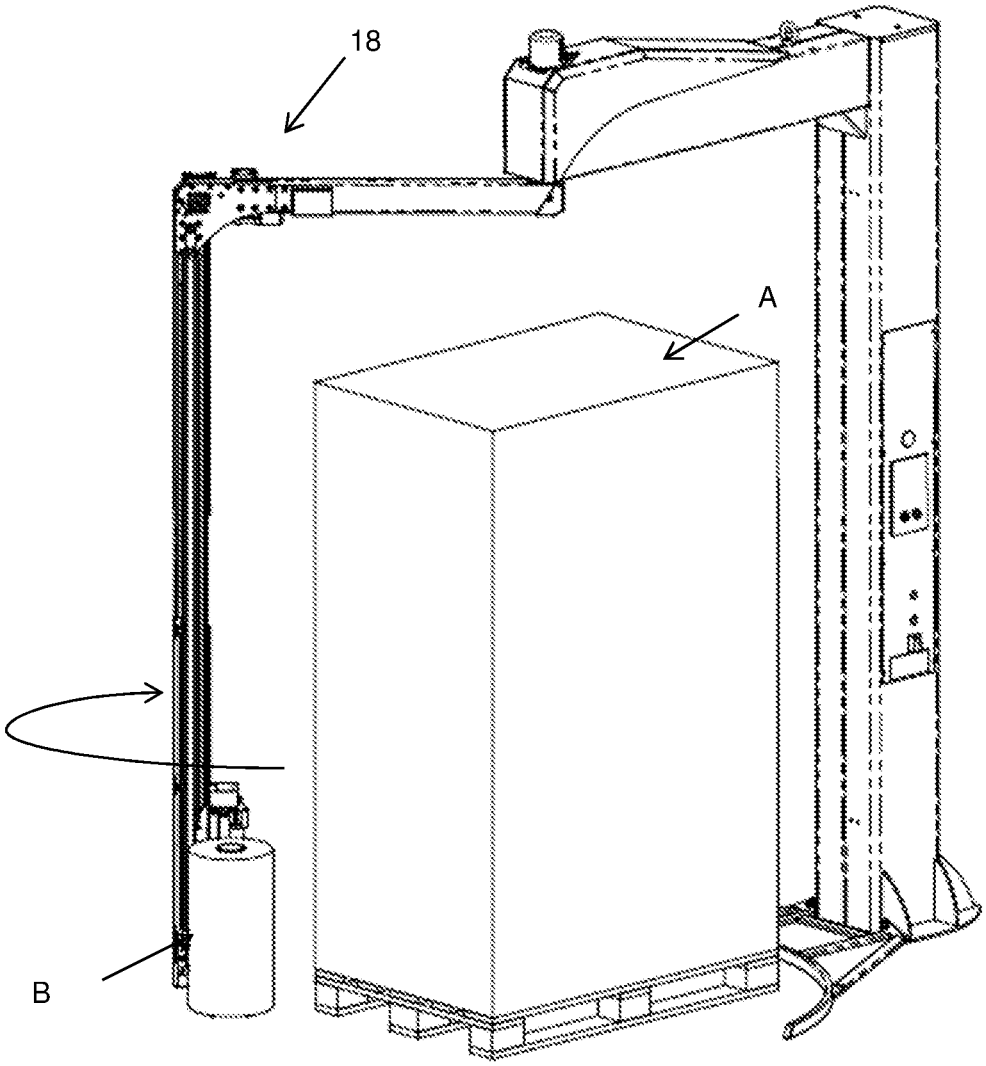
Figure 1c (Prior art)
FIG. 1*c* is an axonometric view of a known in the art semi-automatic apparatus for wrapping a film around an object placed on a pallet, wherein the apparatus rotates around the object to be wrapped by means of a rotating arm.
Figure 2:
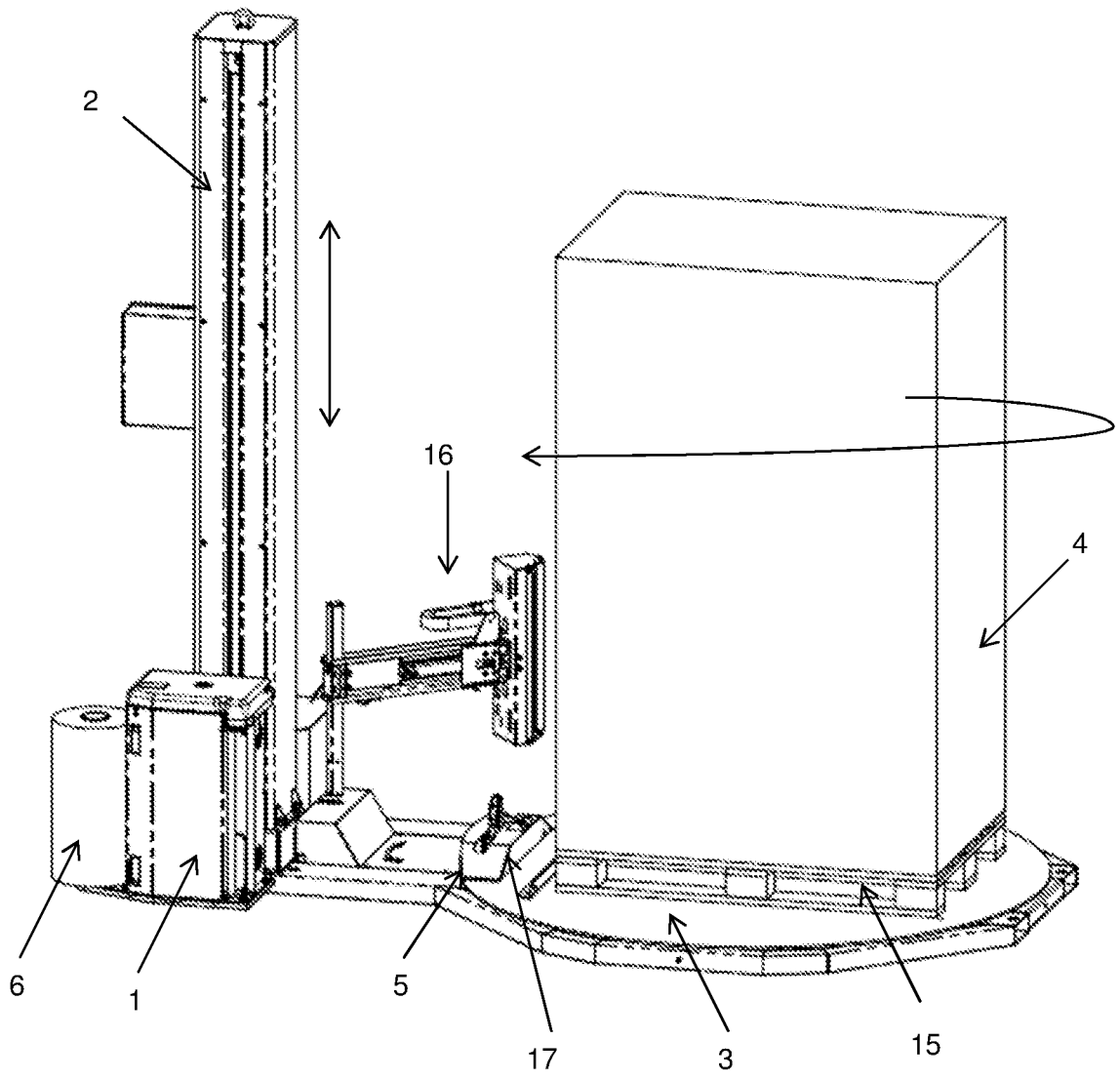
Figure 2 (Prior art)
FIG. 2 is an axonometric view of a known in the art hybrid apparatus to wrap a film around an object placed on a pallet, wherein the latter one rotates around the apparatus, which is instead fixed.
Figure 3:
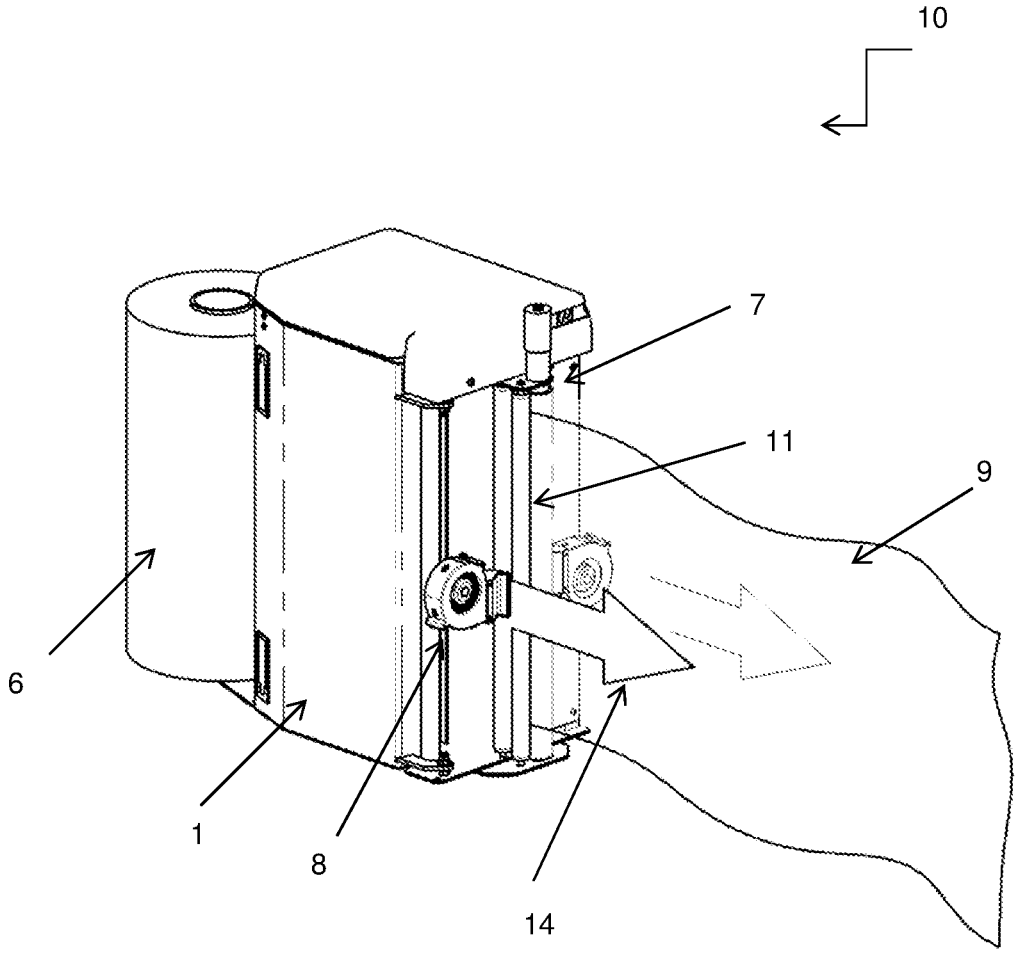
FIG. 3 is an axonometric view of a detail of an embodiment of an apparatus of the present invention.

FIG. 3 shows a detail of the apparatus 10 which includes a carriage 1 suitable for housing a reel of film 6; the carriage 1 is provided with an opening 11 which allows the film 6 to exit from the carriage 1. The apparatus 10 further comprises a vertical column (not shown in FIG. 3, for simplicity, but similar to the column 2 shown in the known in the art apparatus shown in FIG. 2), along which the carriage 1 slides up and down. At the opening 11 there is a motorized roller 7 which, once activated, allows the extraction of the leading end flap 9 of the film 6 from the carriage 1. There is also a fan 8 which generates air blades 14 which run laterally to the leading end flap 9 of the film 6 (and to the entire remaining portion of the film 6 as it exits from the carriage 1), to direct it towards the product to be wrapped 4 (not shown in the figure).

Figure 4:
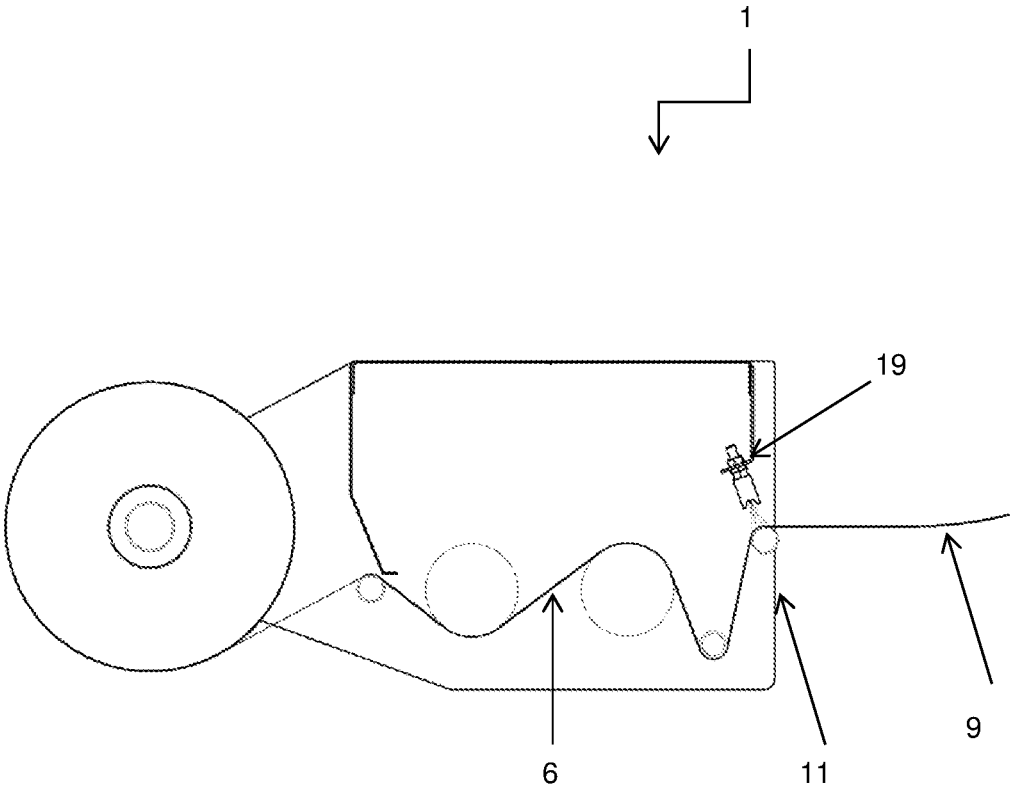
FIG. 4 shows a section in detail of the apparatus in FIG. 3.

FIG. 4 shows in section a detail of the carriage 1 of the apparatus 10 wherein a bar 19 is visible located at the opening 11 through which the film 6 exits from the carriage 1. The bar 19 is of the ionizing type on which a series of emitting tips (electrodes) are fixed, the bar 19 is electrostatically charged by an electronic board that controls and commands the entire system, and the use of a lifting element which, powered by current, increases its voltage and transfers it to the electrodes. When the system is powered up, the bar 19 emits positive ions which are transferred from the bar 19 towards mass which acts as a negative.

The bar 19, once electrostatically charged, is able to transmit this electrostatic charge to the leading end flap 9 of the film 6 which, during its path, crosses this ion beam, charging itself electrostatically, before exiting the carriage 1 through the opening 11.

Figure 5A:
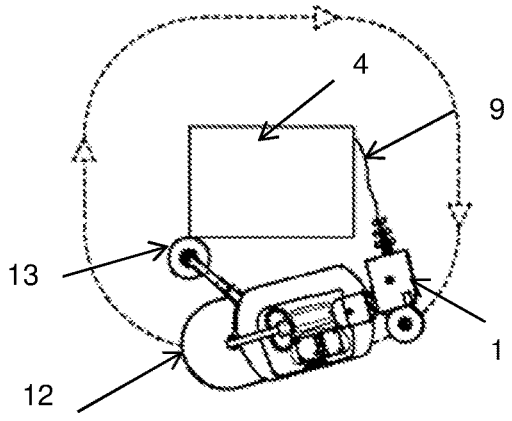
FIGS. 5*a*-5*e* schematically show from above the various rotation phases of a movable body integral with the apparatus of FIG. 3 around the object to be wrapped, which is instead fixed.
Figure 5B:
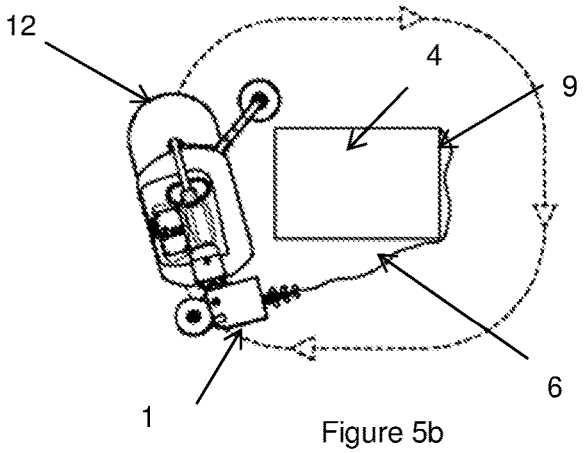
Figure 5C:
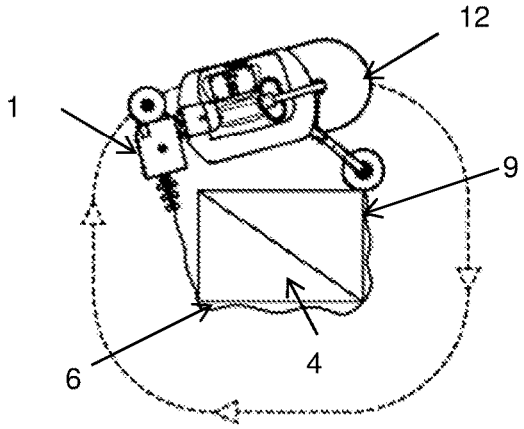
Figure 5D:
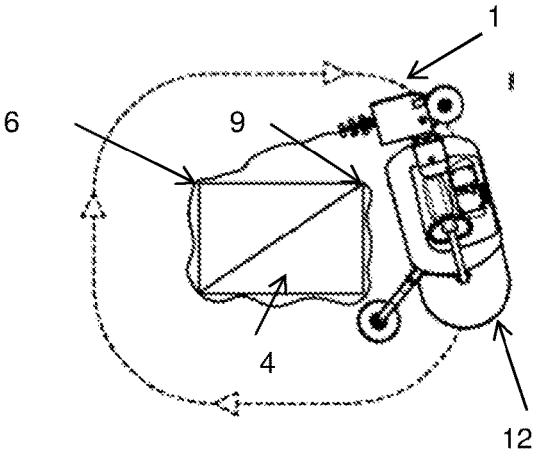
Figure 5E:
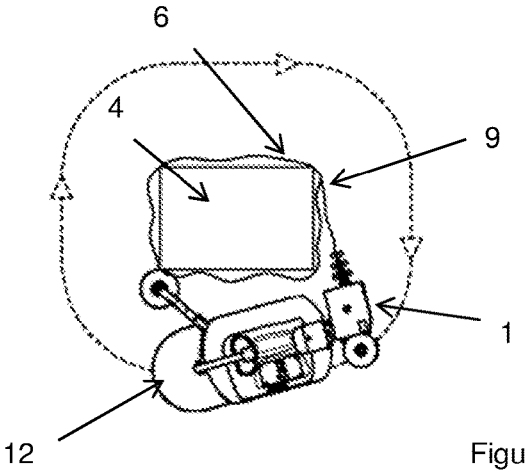

In this way, as soon as it is dispensed, the leading end flap 9, as soon as it meets the object to be wrapped 4 (not shown in the figure), it is immediately fixed to it (FIG. 5*a*) by the attraction force generated by the electrostatic charge the leading end flap 9 of the film 6 is provided with. By continuing the delivery of the film 6, it is thus easier to fix the leading end flap 9 of the film 6 all around the object to be wrapped 4 (FIGS. 5*b*-5*e*), while avoiding the formation of unsightly or annoying film tails at the base of the object. Consequently, once the leading end flap 9 of the film 6 is fixed to the object, it is sufficient to start the wrapping around the object to be wrapped by dispensing the film 6 from the carriage 1 for the required quantity.

Once the first turn of wrapping the film 6 around the object has been completed, the transfer of the electrostatic charge of the bar 19 towards the portion of film 6 exiting the carriage 1 is deactivated. In fact, once the fastening of the film 6 around the object to be wrapped is consolidated by completing the first turn, it is no longer necessary to supply the electrostatic charge to the new portion of film 6 coming out of the carriage 1.

The apparatus 10 of the present invention is therefore easy to manufacture, highly efficient, and economical, as no additional expensive devices are required to allow efficient film fastening to the object to be wrapped, without the need for any intervention by an operator.

In a first embodiment, the apparatus 10 is also provided with a movable body 12 integral with the carriage 1 and able to rotate around the object to be wrapped 4, resting on a pallet; the movable body 12 is provided with at least one wheel 13 to facilitate its movement (FIGS. 5*a*-5*e*).

The movement of the movable body can be managed by means of an electronic board placed inside the movable body 12 itself and manageable via a keyboard and a display arranged on the external surface of the movable body itself to allow programming. In another alternative embodiment, the movable body 12 can also be managed remotely, without limiting the invention to such solutions.

The movement of the carriage 1 along the vertical column 2, the speed with which the film 6 exits from the carriage 1 by means of the motorized roller 7, and the power of the fan 8 capable of generating the air blades 14 can also be managed and programmed by means of such an electronic board, via keyboard or remotely, without limiting the invention to such solutions.

FIGS. 5*a*-5*e* schematically show the various rotation phases of the movable body 12, integral with the carriage 1 of the apparatus 10, around the object to be wrapped 4, which is instead fixed. As the movable body 12 (and with it the carriage 1 integral with it) rotates around the object to be wrapped 4 (clockwise, in FIGS. 5*a*-5*e*), which instead remains fixed, the leading end flap 9 of the film 6 it is put under tension while it wraps around the object 4 itself and with it, consequently also the portion of film 6 as it exits from the carriage 1. The rotation of the movable body 12 can continue until the number of revolutions is completed programmed around the object to be wrapped 4.

In a preferred form, although not essential for the purposes of the invention, the film 6 delivered by the carriage 1 has a length slightly shorter than the path travelled by the movable body 12 while the latter rotates around the object to be wrapped 4. In this way, the film 6 is kept as taut as possible and close to the object to be wrapped 4.

In a second embodiment shown with reference to FIGS. 6*a*-6*e*, the apparatus 10 of the present invention is used to wrap a film 6 around an object 4 placed on a pallet, which in turn is placed on a rotating base 3. In this embodiment, the object to be wrapped 4 rotates on itself in proximity to the apparatus 10, which is instead fixed. Furthermore, in this embodiment there is no movable body 12 of the apparatus 10 seen with reference to FIGS. 5*a*-5*e*, no movement of the apparatus 10 itself being necessary. On the other hand, the methods seen above with which the leading end flap 9 of the film 6 exits from the carriage 1 remain unchanged, by using in particular the electrostatically charged bar 19.

Figure 6A:
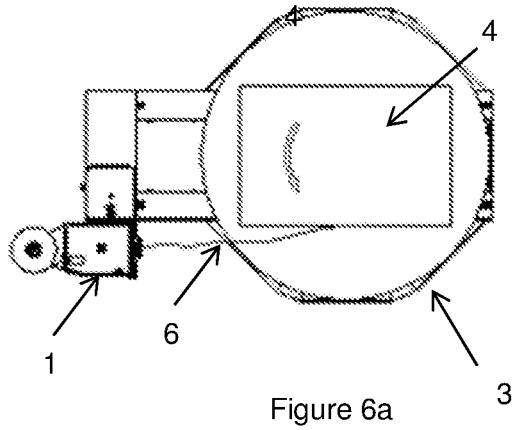
FIGS. 6*a*-6*e* schematically show from above the various rotation phases of an object to be wrapped placed on a rotating table that rotates on itself near the apparatus of FIG. 3 which is instead fixed.
Figure 6B:
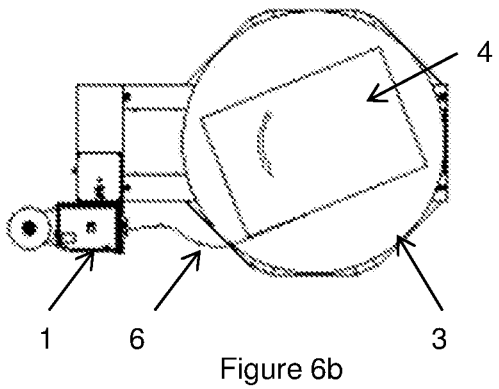
Figure 6C:
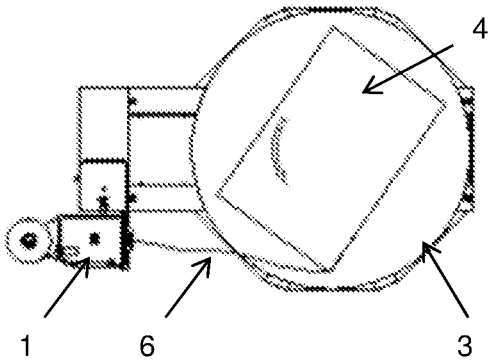
Figure 6D:
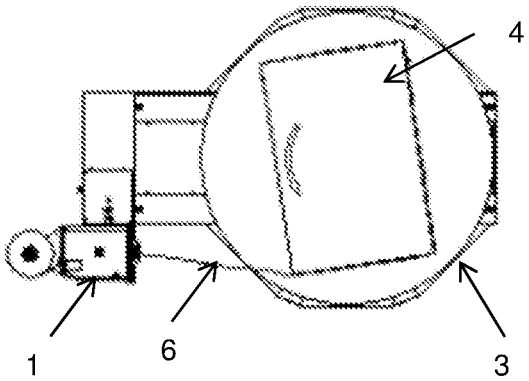
Figure 6E:
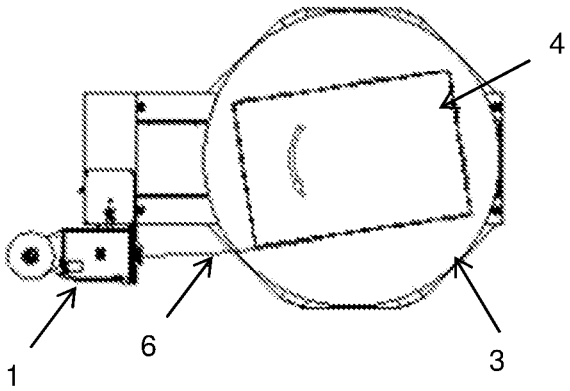

Operationally, the apparatus 10 delivers the leading end flap 9 of the film 6 out of the carriage 1 and pushes it against the side of the object to be wrapped 4, where it is fixed by attraction thanks to the electrostatic charge (FIG. 6*a*) without the need for any intervention by an operator. The rotation on itself of the rotating base 3 on which the object to be wrapped 4 is placed is then activated (FIG. 6*b*); consequently, as it is dispensed from the carriage 1, the film 6 rests along the contour of the object 4 (FIGS. 6*c* and 6*d*), until the leading end flap 9 of the film 6 is brought back to the starting point (FIG. 6*e*). Also in this case, at the end of the first lap, the film 6 overlaps the leading end flap 9, thus fixing the film 6 around the object to be wrapped 4 in a stable manner. The rotation of the object to be wrapped 4 around the apparatus 10 can continue until it has completed the programmed number of revolutions.

Of course, many modifications and variations of the preferred embodiments described above will be apparent to those skilled in the art, still remaining within the scope of the invention.

Therefore, the present invention is not limited to the preferred embodiments described, illustrated only by way of non-limiting example, but is defined by the following claims.

This application claims the benefit of Italian application IT 102021000007820, filed Mar. 31, 2021, the entire contents of which are hereby incorporated by reference.

The invention claimed is:

1. Apparatus (10) for wrapping a film (6) around an object (4), wherein said apparatus (10) comprises a) a carriage (1) adapted to house a reel of said film (6), b) an opening (11) in said carriage (1) to allow said film (6) to exit the carriage (1), c) a motorized roller (7) adapted to facilitate said exit of the film (6) from the carriage (1) through said opening (11); and d) a device (19) placed inside the carriage (1) at said opening (11) along the path traveled by the film (6) exiting the carriage (1) and adapted to be electrostatically charged and transmit said charge to the leading end portion of film (6) exiting said carriage (1) to fix the leading end portion of film (6) to the object (4) to be wrapped.

2. Apparatus (10) according to claim 1, wherein said device (19) is a bar adapted to be electrostatically charged.

3. Apparatus (10) according to claim 1, which also comprises a fan (8) capable of generating air blades (14) designed to direct said film (6) towards the object to be wrapped (4).

4. Apparatus (10) for wrapping a film (6) according to claim 1, further provided with a movable body (12) integral with said carriage (1) able to rotate around said object to be wrapped (4).

5. Method for wrapping a portion of film (6) around an object (4) with the apparatus (10) according to claim 1, wherein said method comprises the steps of:

a) allowing the leading end flap (9) of said film (6) to come out from said carriage (1) through said opening (11);

b) electrostatically charging said leading end flap (9) of the film (6) with the device (19) before or during the film (6) exiting the carriage (1);

c) allowing said leading end flap (9) of the electrostatically charged film (6) to be fixed onto said object (4); and d) wrapping said leading end flap (9) of said film (6) around said object (4) and thereafter wrapping the remaining portion of the film (6) on it as it comes out from said carriage (1).

6. Method according to claim 5 wherein said step b) is carried out by firstly step b1) wherein a device (19) substantially arranged at said opening (11) of the carriage (1) is electrostatically charged, and subsequently step b2) wherein said electrostatic charge is transferred from said device (19) to said leading end flap (9) of said film (6).

7. Method according to claim 5, wherein said step c) of wrapping said leading end flap (9) of said film (6) around said object (4) is carried out by rotating on itself said object to be wrapped (4) in proximity of said apparatus (10), or, alternatively, by rotating a movable body (12) of said apparatus (10), integral with said carriage (1), around said object to be wrapped.

8. Method according to claim 5, wherein said leading end flap (9) of the film (6) coming out of said carriage (1) is directed towards said object (4) by means of air blades (14) generated by a fan (8) placed at said opening (11) of the carriage (1).

9. Apparatus (10) according to claim 1, wherein said device (19) is an ionizing bar comprising electrodes or emitting tips.

10. Apparatus (10) according to claim 1, wherein said device (19) emits positive ions.

* * * * *